United States Patent [19]

Albinger, Jr.

[11] 4,223,303

[45] Sep. 16, 1980

[54] ALARM DEVICES FOR INTERCONNECTED MULTI-DEVICE SYSTEMS

[75] Inventor: Harry Albinger, Jr., Monroe, Conn.

[73] Assignee: General Electric Company, New York, N.Y.

[21] Appl. No.: 968,426

[22] Filed: Dec. 11, 1978

[51] Int. Cl.[2] ..... G08B 17/00

[52] U.S. Cl. ..... 340/531; 340/628

[58] Field of Search ..... 340/531, 533, 628, 629, 340/630, 636, 517, 500

[56] References Cited

U.S. PATENT DOCUMENTS

| | | | |
|---|---|---|---|
| 2,789,282 | 4/1957 | Winters | 322/59 |
| 3,546,692 | 12/1970 | Salzer | 340/517 |
| 3,778,800 | 12/1973 | Blackwell et al. | 340/629 |
| 3,792,279 | 2/1974 | Sasaki | 340/629 |
| 3,909,813 | 9/1975 | Scheidweiler et al. | 340/533 |
| 4,030,086 | 6/1977 | Salem | 340/636 |
| 4,141,007 | 2/1979 | Kavasilios et al. | 340/500 |

*Primary Examiner*—Alvin H. Waring

*Attorney, Agent, or Firm*—George R. Powers; Leonard J. Platt; John F. Cullen

[57] ABSTRACT

Alarm devices are provided with circuit means for permitting interconnection of the alarm devices into an alarm system in which each of the powered alarm devices continually senses for an adverse condition, such as smoke in a smoke detection alarm system, and in which all of the powered alarm devices signal an alarm in response to the sensing of an adverse condition by any one of the powered alarm devices.

10 Claims, 3 Drawing Figures

ALARM DEVICES FOR INTERCONNECTED MULTI-DEVICE SYSTEMS

BACKGROUND OF THE INVENTION

1. Field of the Invention

This invention relates to alarm devices for use in interconnected alarm systems and, more particularly, to battery-operated alarm devices and systems in which an adverse condition such as smoke sensed by one or more of the devices causes all of the interconnected devices to signal an alarm.

2. Description of Prior Art

Alarm devices such as smoke or intrusion alarm devices are often used to signal the existence of an adverse condition. Such devices are typically self-contained in that the sensing apparatus and the alarm apparatus are combined in a single unit which may be placed wherever required to protect the premises. In the case of smoke detection, it is common to locate a number of smoke alarm devices throughout the premises. For example, in a typical home installation, one unit may be placed in the bedroom area while other units may be located in the living area, the garage, and the basement. If the units are totally self-contained, only the unit sensing an adverse condition will signal an alarm. This is undersirable under certain conditions in that the alarm signalling the alarm may be located where it connot be seen or heard, e.g., people sleeping in the bedroom area may not be awakened by a horn alarm sounding in the basement area. To overcome this problem, it has been suggested in the past that alarm devices be provided with remote alarms, thereby substantially extending the warning range of the detection equipment. In this respect, a smoke alarm located in a basement area may be provided with an auxiliary alarm in a bedroom area. While this certainly extends the warning range of the detection equipment, it has a disadvantage of adding significantly to the cost of the overall system since it requires multiple alarm devices for detection in a single location.

The cost problem can be largely overcome by connecting the individual alarm units in parallel such that an adverse condition sensed by any one of the alarm devices will produce a warning signal on all of the interconnected units that are individually connected to operative sources of electric power. To the extent that such an alarm system effectively interconnects the batteries of battery-operating alarms in parallel, battery life can be adversely affected since all batteries will promptly be drawn down to the voltage of the lowest voltage battery in the system. The result will be sharply reduced life for most of the batteries in the system.

SUMMARY OF THE INVENTION

It is therefore a primary object of the invention to provide an improved alarm system for sensing for adverse conditions at a number of locations and for operating all of the alarms in response to the sensing of an adverse condition at only one location.

Another object of the invention is to provide battery-operated alarm devices which may be used individually or interconnected into an alarm system in which all units signal an alarm in response to the sensing of an adverse condition by only one unit.

Still another object of the invention is to provide battery-operated alarm devices which may be interconnected into an alarm system in which the entire system signals an alarm in response to either an adverse condition or a low battery voltage condition at any one of the interconnected alarm devices.

Briefly stated, in carrying out the invention in one form, an alarm device adapted for use in a multidevice alarm system includes terminal means for connection to a source of electric power, an alarm circuit coupled to the terminal means and including a normally conductive alarm means and a normally nonconductive (OFF) switching means connected in series and control means coupled to both the terminal means and the switching means for sensing an adverse condition and supplying a signal over output means to the switching means when an adverse condition is sensed. The switching means is selected such that it switches to its conductive state only while an output signal is being supplied to it by the output means. Circuit means are connected to the output means so as to permit the interconnection of the output means to the output means of other alarm devices. In this manner, an output signal generated by the control means of one alarm device will be supplied to the switching means of all of the interconnected alarm devices. As a result all of the interconnected alarm devices that are connected to a source of electric power will operate in response to the sensing of an adverse condition by any one of the interconnected alarm devices.

By a further aspect of the invention, the alarm device further comprises voltage sensing means coupled to the terminal means for sensing the voltage of a battery connected to the terminal means, the voltage sensing means supplying an output signal to the output means when the voltage drops below a predetermined level. In this manner, the alarm means of all of the interconnected and powered alarm devices signal an alarm in response to a low battery condition existing at any one of the alarm devices. The alarm devices also include means for establishing at the output means a voltage sufficient to turn ON the switching means, preferably a silicon-controlled rectifier (SCR). The voltage establishing means is in accordance to the preferred embodiment of the invention a plurality of diodes connected in series. The circuit means connects the voltage establishment means of the alarm devices in parallel such that a turn-on voltage established by any one alarm device will be supplied to the switching means of all of the alarm devices.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in connection with the drawings, in which:

DETAILED DESCRIPTION

Figure 1:
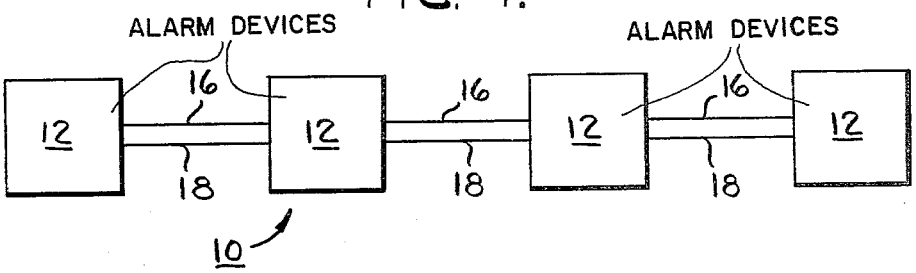
FIG. 1 is a diagrammatic view of an alarm system utilizing the present invention.

Referring first to FIG. 1, an alarm system 10 having four alarm devices 12 interconnected in accordance with the invention is illustrated. Each of the alarm devices 12, which may be a smoke alarm or an intrusion alarm or the like, is powered by a self-contained battery. The alarm devices 12 are interconnected by leads 16 and 18 in a manner hereinafter described. The function of the leads 16 and 18 is to assure that each of the alarm devices 12 signals an adverse condition. In this manner, there is a greater likelihood that a dangerous condition will be communicated since all of the devices will signal an alarm even though only one device actually senses the adverse condition. As this description proceeds, it will become evident that the interconnected alarm devices 12 will work in the foregoing manner only if all of the devices are connected to an operative source of electric power. Any unit not so connected will neither sense for an adverse condition nor signal an alarm; the units properly connected to operative sources of electric power will continue to function as part of an integrated system.

Figure 2:
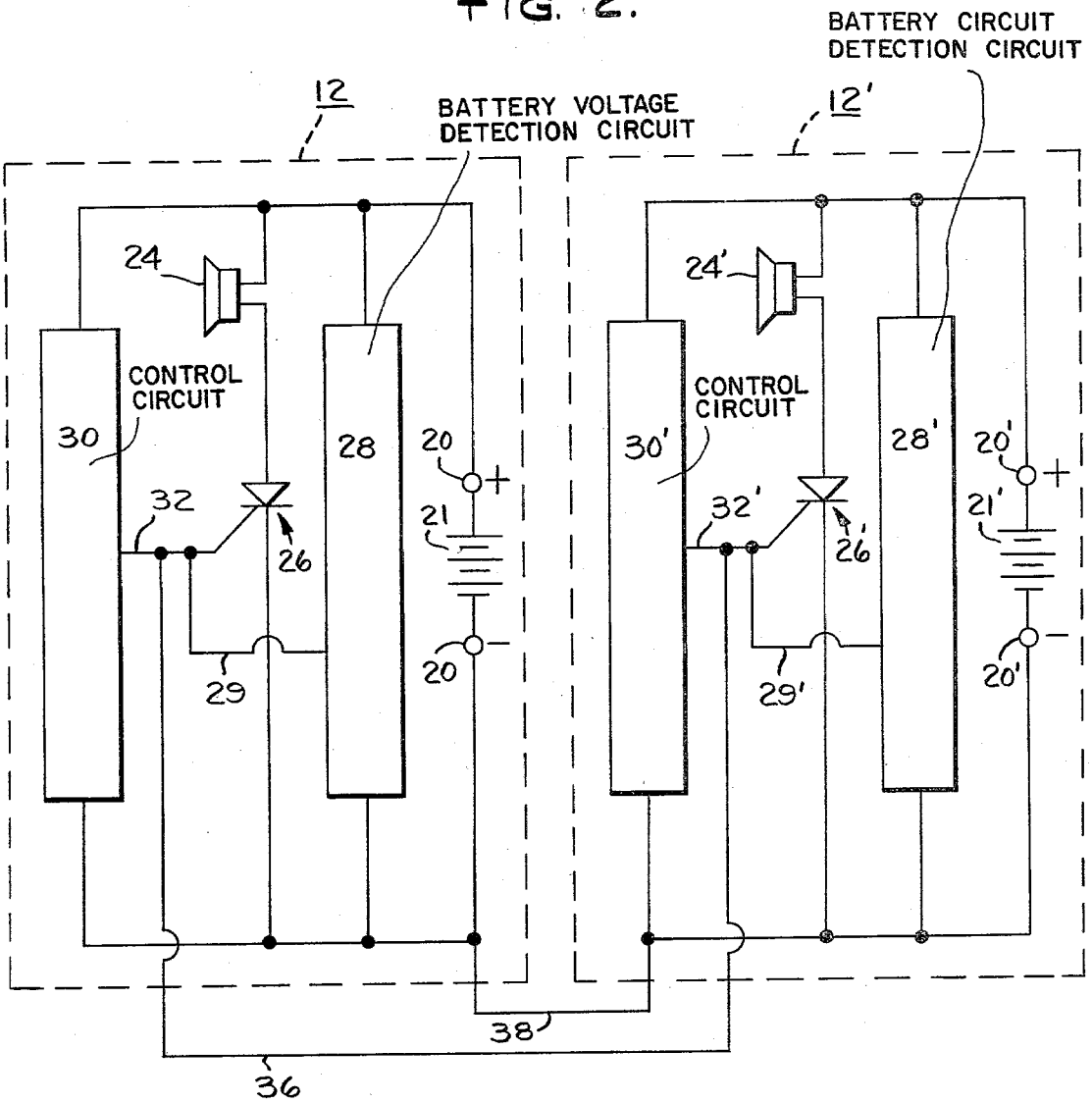
FIG. 2 is a diagrammatic view showing two alarm devices interconnected in accordance with the invention.

Referring now to FIG. 2, two of the alarm devices 12 are disclosed in somewhat greater detail, the second one of the alarm devices and its components being identified by primed numerals for convenience. As illustrated, each of the alarm devices 12 has a pair of terminals 20 through which internal electric power may be supplied to the device. As indicated above, this power is preferably direct current electric power supplied by an internal battery 21. The terminals 20 are coupled to an alarm circuit comprising a normally conductive horn 24 and a normally non-conductive (OFF) semi-conductor switch 26 which is preferably a silicon-controlled rectifier (SCR) as shown. A control circuit 30 is also coupled to the terminals 20, the function of the control circuit 30 being to sense for an adverse condition, such as smoke, and to produce an output signal on line 32 whenever the adverse condition is sensed. The gate of the SCR 26 is connected to receive output signals over line 32 and to maintain the SCR 26 in its conductive (ON) state so long as an output signal is produced by the control circuit 30. The terminals 20 are also connected to a battery voltage detection circuit 28, which monitors the voltage of the battery and produces an output signal on line 29 whenever the battery voltage drops below a predetermined level. The line 29 is also connected to the gate of the SCR 26.

The general mode of operation of the alarm system 10 will now be described with reference to FIGS. 1 and 2. If each of the alarm devices is connected to an operative battery 21, direct current electric power of suitable voltage, such as nine volts, will be supplied to the alarm circuit comprising the horn 24 and the SCR 26, the control circuit 30 and the battery voltage detection circuit 28. So long as an adverse condition is not sensed by the control circuit 30 of any one of the units 12 all of the SCR's 26 will remain OFF and no alarm signal will be produced. If, however, circuit 30 of any one of the alarm devices 12 produces an output signal on line 32 indicative of the presence of an adverse condition, the associated SCR 26 will turn ON, thereby closing the alarm circuit of that alarm device and causing its horn 24 to sound. In addition, the horns 24 of each of the other interconnected devices 12 will also sound. This will be better understood from consideration of the two alarm devices 12 and 12' illustrated in FIG. 2. Thus, if the control circuit 30 of the alarm device 12 senses an adverse condition, it will produce an output signal on line 32 and turn ON the SCR 26. The turning ON of the SCR 26 closes the alarm circuit coupled to the terminals 20 such that current flows through the alarm circuit so as to sound the horn 24, the electric current being supplied by the battery of the device 12.

The output signal on line 32 is also supplied over line 36 to line 32' and the gate of the SCR 26' of the alarm device 12'. The negative terminals 20 and 20' are also connected by line 38. As a result, the SCR 26' also turns ON, and the horn 24' sounds even though its control circuit 30' has not sensed an adverse condition. Similarly, if the voltage of the battery coupled to the terminals 20 of the device 12 drops below a predetermined level, the voltage detection circuit 28 will detect the low voltage condition and produce an output signal on line 29, which is connected not only to the SCR 26, but also through the line 36 to the gate of the SCR 26'. As a result, a low battery voltage condition in any one of the alarm devices 12 will turn on the SCR's 26 of all of the powered units to produce a suitable alarm signal. Again, it should be noted that the alarm device 12' will sound an alarm only if it is powered by an energized battery 21', and the device 12 will sound an alarm only if it is powered by its own battery 21.

Figure 3:
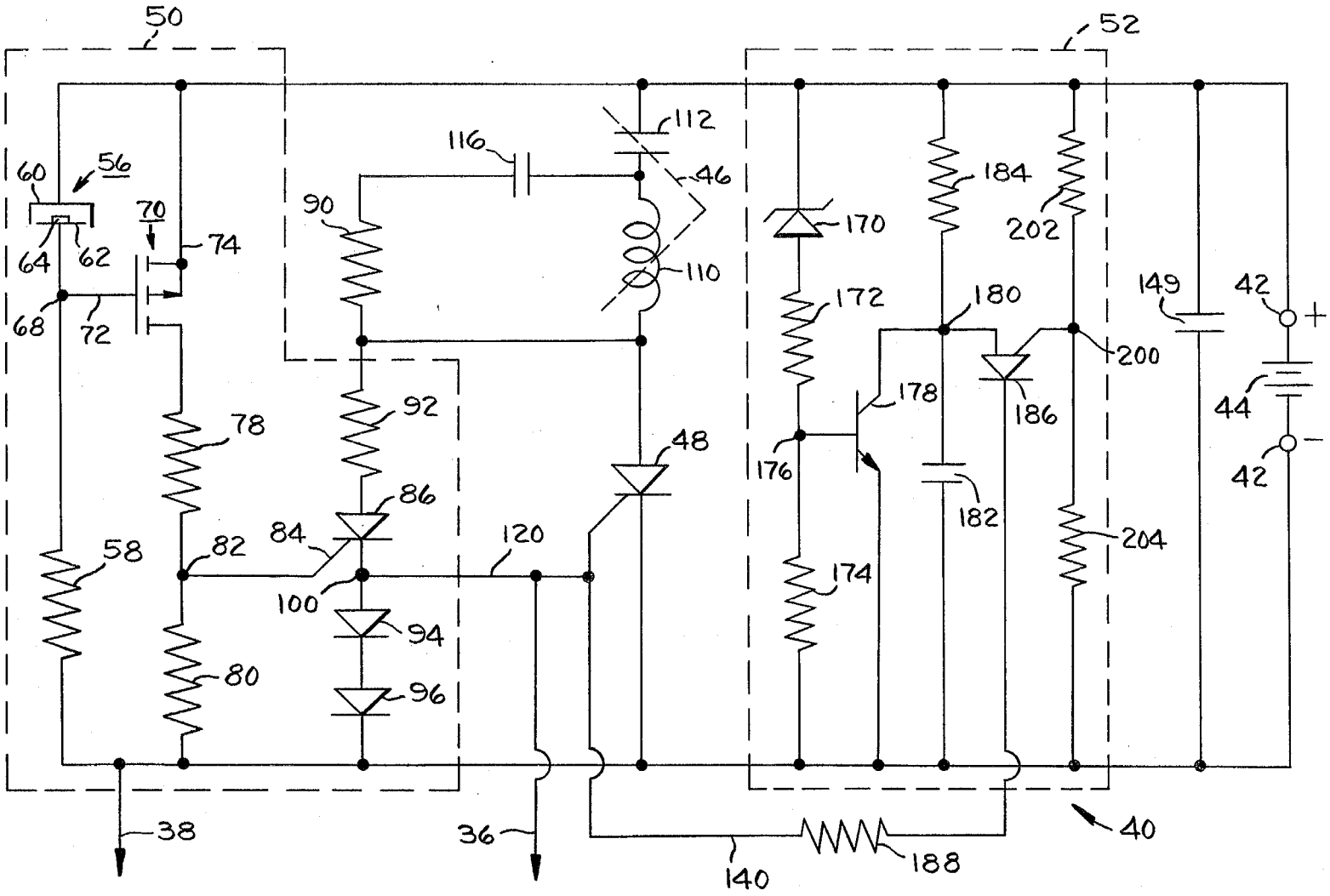
FIG. 3 is a circuit diagram of a smoke detector utilizing the present invention.

Referring now to FIG. 3, a smoke detector 40 incorporating the present invention is illustrated, the smoke detector 40 being capable of operation as a single unit or as an alarm device 12 in an alarm system 10 as illustrated in FIGS. 1 and 2. The smoke detector 40 includes a pair of terminals 42 connected across a battery 44 for supplying electric power at a substantially fixed voltage, e.g. nine volts, to an alarm circuit comprising a horn 46 and an SCR 48 connected across the terminals 42. A capacitor 49 is provided across the terminals 42 to prevent rapid changes in supply voltage during sounding of the horn 46. A control circuit enclosed within a block 50 is also connected across the terminals 42, and a battery voltage detection circuit enclosed within a block 52 is also connected across the terminals 42.

The control circuit 50 includes an ionization chamber 56 and a resistor 58 connected in series across the terminals 42. The chamber 56 is open to the atmosphere and its interior is thus freely accessible to air and airborne products of combustion or aerosols. For reasons which will become apparent as this description proceeds, the chamber 56 is a measuring chamber and the resistor 58 is a substantially fixed reference resistance.

As illustrated, the measuring chamber 56 includes a pair of spaced-apart electrodes 60 and 62 and a source 64 of alpha radiation such as Americium 241 for ionizing the air in the interior space between the electrodes 60 and 62. An ion current will flow between the electrodes 60 and 62 when a voltage is applied thereacross. If aerosols or products of combustion enter the interior space of the chamber 56, the current flow will be reduced if the voltage across the electrodes is maintained constant. In other words, the introduction of combustion aerosols increases the electrical resistance of the chamber 56, the amount of resistance change being indicative of the amount of combustion products present in the chamber 56. Since the battery 44 maintains an essentially fixed voltage and the resistor 58 has a substantially fixed resistance, the introduction of smoke or other products of combustion into the chamber 56 will thus cause a reduction in the voltage at junction 68.

A MOSFET field effect transistor 70 of the enhancement type has its gate 72 coupled to the junction 68 intermediate the chamber 56 and the resistor 58. The source 74 of the MOSFET 70 is connected to the positive terminal 42, and the drain 76 of the MOSFET 70 is connected through resistors 78 and 80 to the negative terminal 42. The junction 82 between the resistors 78 and 80 is connected to the gate 84 of an SCR 86. The SCR 86 is part of a series circuit across the terminals 42, the circuit comprising the horn 46 and a resistor 92 between the positive terminal 42 and the anode of the SCR 86 and a pair of series-connected diodes 94 and 96 between the cathode of the SCR 86 and the negative terminal 42. The current through the SCR 86 is insufficient to turn the horn 46 on, i.e., sound an alarm. The junction 100 between the SCR 86 and the diodes 94 and 96 is connected by line 120 to the gate of the SCR 48, which is also in series with the horn 46 across the terminals 42.

The normally conductive horn 46 is represented by a coil 110 in series with the SCR 48 and a pair of normally closed contacts 112 mechanically connected to the horn mechanism for being rapidly opened and closed during sounding of the horn. A series circuit of a resistor 90 and a capacitor 116 is provided in parallel across the horn coil 110 to prevent large inductive spikes, which could damage other circuit components, from being generated by the coil when the horn is sounding.

When there is no smoke or other airborne products of combustion within the measuring chamber 60, the voltage at junction 68 relative to the voltage on the source 74 is less than the threshold voltage of the MOSFET 70. Since the MOSFET 70 is of the enhancement type, this means that the MOSFET is essentially OFF (not conducting) under these conditions. Since the MOSFET 70 is essentially OFF, there is substantially no current flow through the resistors 78 and 80 and the junction 82 is maintained at a voltage substantially identical to that of the negative terminal 42. The SCR 86 is thus also maintained in its OFF or non-conductive condition. This causes the junction 100 to be maintained at a voltage substantially identical to that of the negative terminal 42. As a result, no output signal is produced on line 120 to the SCR 48, which thus remains in its OFF or non-conductive state, and the horn 46 does not sound.

If smoke or other combustion products enter the chamber 60, the voltage across the chamber 60 and the source-to-gate voltage of the MOSFET 70 will increase and progressively turn on the MOSFET 70. Once the MOSFET 70 reaches a preselected conduction level, current flow through the resistors 78 and 80 causes the voltage at junction 82 to increase sufficiently to turn on the SCR 86. The diodes 94 and 96 assure that a voltage of at least 0.8 volts is maintained at junction 100 while the SCR 86 conducts, this voltage being sufficient to turn ON the SCR 48 and thus cause the horn 46 to sound. The output voltage at junction 100 is also transmitted over line 36 to the SCR's of other interconnected smoke detectors in the manner described above with respect to FIGS. 1 and 2. In this manner, the horns of all of the interconnected powered smoke alarms will be turned ON and all of the powered horns will sound. The resistance of the resistor 92 is selected such that the current flowing through the SCR 86 will be sufficient to turn ON several smoke alarms. For example, the resistor 92 may be conveniently selected such that approximately 3.5 milliamps flows through the SCR 86, thus allowing at least 200 microamps to be supplied to ten or more interconnected smoke alarms.

If the smoke level in the chamber 56 subsequently drops below the preselected trigger point, the voltage at the junction 68 will rise, and the source-to-gate voltage on the MOSFET 70 will therefore fall below the level required to maintain the preselected level of conduction through the MOSFET 70 and the resistors 78 and 80. This means that the voltage at junction 82 will also fall and the SCR 86 will turn OFF when its current falls below its holding level (due to periodic opening during horn operation of the normally closed contacts 112). This in turn will cause the SCR 48, the horn 46, and any interconnected horns to turn off.

It will be noted that the smoke detector 40 is capable of functioning as an individual smoke detector not connected to any other alarm device. To function as an individual unit, the terminals 42 must, of course, be connected to a battery 44. Alternatively, the lines 36 and 38 of two or more units may be interconnected into an alarm system as described above with respect to FIGS. 1 and 2. In this latter case, each of the detectors must be connected to a battery in order for it to detect smoke or to sound an alarm when smoke is sensed by another one of the detectors. The interconnected detectors having operative batteries will, however, remain fully operative even if one interconnected detector is not connected to an energized battery.

As indicated above, each of the smoke detectors 40 includes a battery voltage detection circuit 52. The circuit 52 detects whenever the voltage of a battery 44 connected across terminals 42 drops below a predetermined level. Whenever this occurs, an output signal is produced on line 140 and is supplied to the gate of SCR 48, thus causing SCR 48 to turn ON and the horn 46 to sound. By means of line 36, the signal supplied over line 140 is also supplied to the other interconnected smoke detectors 40 such that the horns of all of the powered smoke detectors will sound whenever the voltage of any one of the batteries drops below a predetermined level.

Apart from the interconnection aspect, the battery voltage detection circuit 52 of this application is virtually identical to the voltage detection circuit disclosed by U.S. Pat. No. 4,030,086 for "Battery Voltage Detection and Warning Means", granted on June 14, 1977, to Robert J. Salem and assigned to the assignee of this application. For a detailed description of the circuit, reference is made to such issued patent, and its description is hereby incorporated herein.

As taught by said aforesaid Salem patent, the low battery energy detection and warning system includes a zener diode 170 and a pair of resistors 172 and 174 connected in series across the terminals 42. The zener diode 170 maintains a predetermined voltage drop at all battery voltages such that the resistors 172 and 174 experience the full voltage drop when the battery connected to the terminals 42 drops in voltage. A junction 176 between the resistors 172 and 174 is connected to the base of an NPN transistor 178 having its emitter connected to the negative terminal 42 and its collector connected to a junction 180. A capacitor 182 is connected between the junction 80 and the negative terminal and a resistor 184 is connected between the junction 180 and the positive terminal. The junction 180 is also connected to the anode of a programmable unijunction transistor (PUT) 186, which has its cathode connected through a resistor 188 and line 140 to the gate of the SCR 48. The gate of the PUT 186 is connected to a junction 200 between two resistors 202 and 204 connected across the terminals 42. Since the circuit comprising the resistors 202 and 204 functions as a voltage divider, the voltage at the junction 200 will follow the battery voltage on a proportional basis.

The operation of the battery energy detection and warning means will now be described with reference to FIG. 3. The zener diode 170 and the resistors 172 and 174 are selected such that the voltage at junction 176 is sufficient to turn on the transistor 178 when the battery voltage is above a predetermined level and such that the voltage at the junction 176 is insufficient to maintain the transistor 178 conductive when the battery voltage drops below the predetermined level. This means that the transistor 178 is normally conductive, permitting current flow between the junctions 42 through the resistor 184 and preventing the buildup of the charge on the capacitor 182. When, however, the battery voltage drops below the predetermined level, the transistor 178 starts to turn OFF, and a charge will build up over a period of time on the capacitor 182. The voltage at junction 180 will eventually rise to a level sufficient to turn ON the PUT 186, which will rapidly discharge the capacitor 182 through the resistor 188. The voltage at junction 180 will thus drop rapidly, and the PUT 186 will turn OFF. Since the terminal voltage is still below the predetermined level and the transistor 178 is at least partially OFF, the capacitor 182 will start charging again through the resistor 184. As a result, the PUT 186 will turn ON again as soon as the voltage at the junction 180 reaches the necessary trigger point for the PUT 186. In this manner, it may be said that output signals are periodically produced at the cathode of the PUT 186 whenever the voltage at the junctions 42 fall below the predetermined level for a period of time. If for some reason the battery voltage should drop for a brief period of time, an output signal would not be produced at the cathode of the PUT 186 since the capacitor 182 would not have sufficient time to charge before the transistor 178 is turned ON again to discharge the capacitor.

Each time an output signal is produced at the cathode of the PUT 186, it is supplied over line 140 to the gate of the SCR 48 to turn ON the horn 46 in the manner described above. The horn 46 will sound so long as the PUT 186 remains ON. In this manner, a low battery voltage condition will result in a series of intermittent blasts of the horn 46. The discharge of the capacitor 182 will also provide a turn-on signal over line 36 to the SCR 26' of all smoke detectors 12' (as shown by FIG. 2) coupled to the smoke detector illustrated by FIG. 3. As a result, a low battery voltage condition existing in any one of the detectors will be signalled by all of the powered smoke detectors coupled to the detector having the low voltage battery.

As indicated above, the interconnection arrangement of this invention requires that each smoke detector be powered by its own battery in order to warn of an adverse sensed condition from another interconnected system. For an alternative arrangement in which only one detector must be connected to an operative source of electric power, attention is directed to the alarm device disclosed and claimed by copending patent application Ser. No. 968,514, entitled "Alarm Devices for Interconnected Multi-Device Systems" filed on Dec. 6, 1978, now U.S. Pat. No. 4,194,192 and assigned to the assignee hereof, General Electric Company.

While the invention has been particularly shown and described with reference to a preferred embodiment thereof, it will be understood by those skilled in the art that various changes in form, details, and application may be made therein without departing from the spirit and scope of the invention. Accordingly, it is intended that all such modifications and changes be included within the scope of the appended claims.

What is claimed as new and is desired to secure by Letters Patent of the United States is:

1. An alarm device adapted for use in a multi-device alarm system, said alarm device comprising:

terminal means for connection to a source of electric power, an alarm circuit coupled to said terminal means, said alarm circuit comprising normally conductive alarm means connected in series with a normally non-conductive (OFF) switching means, control means including sensing means for sensing an adverse condition, said control means having output means coupled to said switching means for supplying an output signal to said switching means when an adverse condition is sensed by said sensing means, said switching means switching to a conductive state (ON) only while an output signal is supplied thereto, and circuit means connected to said output means for permitting the interconnection of said output means to the output means of one or more other alarm devices such that an output signal generated by said control means will be supplied to the switching means of all of the interconnected alarm units, whereby the alarm means of all of the interconnected alarm devices that are connected to a source of electric power will be operated in response to the sensing of an adverse condition by the sensing means of any one of the interconnected alarm devices.

2. An alarm device as defined by claim 1 in which said switching means comprises a semi-conductor switching element having a control input coupled to the output means of said control means for receiving output signals therefrom.

3. An alarm device as defined by claim 2 in which said semi-conductor switching element is a silicon-controlled rectifier (SCR), and in which said control means further comprises at least one detection element for detecting the presence of combustion and an electronic circuit for producing an output signal when combustion is sensed.

4. An alarm device as defined by claim 3 in which said control means includes means for establishing at said output means a predetermined voltage sufficient to turn ON said SCR in response to the sensing of an adverse condition, said circuit means being connected to said voltage establishment means for permitting the interconnection of said voltage establishment means in parallel with the voltage establishment means of one or more other alarm devices.

5. An alarm device as defined by claim 4 in which said voltage establishment means comprises a plurality of diodes connected in series.

6. An alarm device as defined by claim 3 further comprising voltage sensing means coupled to said terminal means for sensing the voltage of a battery connected thereto, said voltage sensing means coupled to said output means for supplying an output signal thereto when the battery voltage drops below a predetermined level, whereby the alarm means of all of the interconnected alarm devices that are connected to batteries will be operated in response to a low battery voltage condition existing at any one of the alarm devices.

7. An alarm device as defined by claim 6 in which said control means includes means for establishing at said output means a predetermined voltage sufficient to turn ON said SCR in response to the sensing of an adverse condition, said circuit means being connected to said voltage establishment means for permitting the interconnection of said voltage establishment means in parallel with the voltage establishment means of one or more other alarm devices.

8. An alarm device as defined by claim 7 in which said voltage establishment means comprises a plurality of diodes connected in series.

9. An alarm device as defined by claim 8 further comprising voltage sensing means coupled to said terminal means for sensing the voltage of a battery connected thereto, said voltage sensing means coupled to said output means for supplying an output signal thereto when the battery voltage drops below a predetermined level, whereby the alarm means of all of the interconnected alarm devices that are connected to batteries will be operated in response to a low battery voltage condition existing at any one of the alarm devices.

10. An adverse condition sensing and alarm system comprising:

a plurality of adverse condition sensing and alarm devices each comprising:

terminal means for connection to a source of electric power;

an alarm circuit coupled to said terminal means, said alarm circuit comprising normally conductive alarm means connected in series with a normally non-conductive (OFF) switching means; and control means including sensing means for sensing an adverse condition, said control means having output means coupled to said switching means for supplying an output signal to said switching means when an adverse condition is sensed by said sensing means, said switching means switching to a conductive state (ON) only while an output signal is supplied thereto; and means interconnecting all of said output means such that an output signal generated by any one of said control means will be supplied to the switching means of all of said alarm devices, whereby the alarm means of all of said alarm devices that are connected to a source of electric power will be operated in response to the sensing of an adverse condition by the sensing means of any one of the alarm devices.

* * * * *